US007157407B2

(12) United States Patent
Serizawa

(10) Patent No.: US 7,157,407 B2
(45) Date of Patent: Jan. 2, 2007

(54) HEAT-SENSITIVE RECORDING MATERIAL

(75) Inventor: Shinichiro Serizawa, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 138 days.

(21) Appl. No.: 10/910,107

(22) Filed: Aug. 3, 2004

(65) Prior Publication Data

US 2005/0032642 A1 Feb. 10, 2005

(30) Foreign Application Priority Data

Aug. 5, 2003 (JP) ..... 2003-205961

(51) Int. Cl.
*B41M 5/20* (2006.01)

(52) U.S. Cl. ..... 503/200

(58) Field of Classification Search .... 428/32.6–32.87; 503/200–226

See application file for complete search history.

(56) References Cited

U.S. PATENT DOCUMENTS 4,803,191 A * 2/1989 Tamagawa et al. ..... 503/200
5,763,009 A * 6/1998 Kegasawa et al. ..... 427/366
5,977,019 A * 11/1999 Ozeki et al. ..... 503/204
6,335,102 B1 * 1/2002 Tsubaki et al. ..... 428/513

FOREIGN PATENT DOCUMENTS

JP 11-200283 A 7/1999
JP 11-200284 A 7/1999
JP 11-200285 A 7/1999
JP 3128248 B2 11/2000
JP 2002-173896 A 6/2002

* cited by examiner

*Primary Examiner*—Bruce H. Hess
(74) *Attorney, Agent, or Firm*—Sughrue Mion, PLLC

(57) ABSTRACT

The present invention relates to a heat-sensitive recording material including a support containing a paper substrate, and a recording layer, in which a base paper of the support is made from pulp slurry containing at least (1) one kind of polyacrylamide or cationic starch and (2) at least one kind of alkyl ketene dimer and epoxydized fatty acid amide as a sizing agent, and is produced by coating or impregnating at least one face thereof with (3) at least one kind of softening agent. The softening agent is preferably a reaction product of a polyamine and a fatty acid having 8 to 40 carbon atoms, a polyhydric alcohol type nonionic surfactant, a cationic surfactant, or a polyamine-based compound.

14 Claims, No Drawings

HEAT-SENSITIVE RECORDING MATERIAL

CROSS-REFERENCE TO RELATED APPLICATION

This application claims priority under 35 USC 119 from Japanese Patent application No. 2003-205961, the disclosure of which is incorporated by reference herein.

BACKGROUND OF THE INVENTION

1. Field of the Invention

The present invention relates to a heat-sensitive recording material, and specifically, to a heat-sensitive recording material in which the softness of a base paper is made high to improve the flatness thereof while maintaining paper strength, thereby giving a high image quality.

2. Description of the Related Art

The heat-sensitive recording method, in which heat is supplied from a thermal head or the like to develop a color or record an image, is classified into the direct heat-sensitive recording method, in which heat is supplied to a recording layer provided on a support so as to record an image, and the heat-sensitive transfer recording method. The latter heat-sensitive transfer recording method is classified into the thermal wax transfer recording method, in which a transfer sheet having a heat-meltable colored ink layer is imagewise heated and then the ink is melted and adhered to an image-receiving sheet so as to form an image, and the dye-sublimation transfer recording method, in which a transfer sheet having an ink layer containing a sublimating dye is heated to diffuse and transfer the sublimating dye onto an image-receiving sheet.

In recent years, such heat-sensitive recording methods have been remarkably developed since the methods have many advantages such as that recording devices for the methods are convenient, highly reliable and maintenance free. The heat-sensitive recording material used in the heat-sensitive recording methods has, on a support, a heat-sensitive recording layer including, for example, an electron-donating dye precursor and an electron-accepting compound, or a diazonium salt and a coupler as color forming components. The color forming components advance a color developing reaction by receiving heat, and this color developing reaction is used to record an image.

As described above, heat-sensitive recording materials have a structure in which a heat-sensitive recording layer is formed on a support; therefore, the flatness of the surface of the support is a particularly important property. When the support comprises a paper substrate, in general, a softening agent or a bulk promoter is incorporated into a base paper to loosen the binding force between fibers therein, thereby making the base paper easy to deform, and then the surface of the base paper is flattened by calendar treatment. However, such a softening treatment has a problem that the mechanical strength of the base paper itself is lowered and is easily damaged.

In order to obtain a pulp sheet excellent in softness or bulkiness without damaging the strength of the base paper, the following have been suggested: a base paper comprising a bulk promoter such as an ester compound of a polyhydric alcohol and a fatty acid (see, for example, Japanese Patent Application Laid-Open (JP-A) No. 2002-173896); a bulk promoter for paper comprising a polyhydric alcohol type nonionic surfactant (see, for example, Japanese Patent No. 3128248); a bulk promoter for paper comprising a nonionic surfactant (see, for example, JP-A No. 11-200283); a bulk promoter for paper comprising a compound represented by the formula $R^1COO(EO)_m(PO)_nR^2$ (see, for example, JP-A No. 11-200284); and a bulk promoter for paper comprising a specific nonionic surfactant and a specific anionic surfactant in a specific ratio (see, for example, JP-A No. 11-200285).

However, paper supports in which high levels of strength and flatness of a base paper are compatible with each other have not yet been achieved even according to the above-mentioned specific softening agent (or bulk promoter), surfactant, and composition thereof. Thus, further research and development have been desired.

SUMMARY OF THE INVENTION

The present invention has been made in light of the above-mentioned situation and provides a heat-sensitive recording material in which the softness of a base paper is made high to improve the flatness thereof while the paper strength thereof is maintained, thereby giving a high image quality.

The invention is to provide a heat-sensitive recording material comprising a support comprising a paper substrate, and a recording layer that is provided thereon and is capable of developing a color by application of heat; a support comprising a paper substrate, and a recording layer that is provided thereon and is capable of being melted and transferred by application of heat; or a support comprising a paper substrate, and a recording layer that is provided thereon and is capable of being sublimated and transferred by application of heat; wherein a base paper of the support is made from pulp slurry comprising at least (1) one kind of polyacrylamide or cationic starch and (2) at least one kind of alkyl ketene dimer and epoxydized fatty acid amide as a sizing agent, and is produced by coating or impregnating at least one face thereof with (3) at least one kind of softening agent.

DETAILED DESCRIPTION OF THE INVENTION

The heat-sensitive recording material of the present invention is a heat-sensitive recording material comprising a support comprising a paper substrate, and a recording layer that is provided thereon and is capable of developing a color by application of heat; a support comprising a paper substrate, and a recording layer that is provided thereon and is capable of being melted and transferred by application of heat; or a support comprising a paper substrate, and a recording layer that is provided thereon and is capable of being sublimated and transferred by application of heat; wherein a base paper of the support is made from pulp slurry comprising at least (1) one kind of polyacrylamide or cationic starch and (2) at least one kind of alkyl ketene dimer and epoxydized fatty acid amide as a sizing agent, and is produced by coating or impregnating at least one face thereof with (3) at least one kind of softening agent.

The heat-sensitive recording material of the invention is a high-quality heat-sensitive recording material attaining both an improvement in the strength of a base paper and an improvement in the flatness of a base paper by using a base paper produced from pulp slurry containing at least (1) one kind of polyacrylamide or cationic starch and (2) at least one kind of alkyl ketene dimer and epoxydized fatty acid amide as a sizing agent, the base paper being produced by surface-sizing (coating or impregnating) at least one face thereof with (3) a softening agent.

Hereinafter, the major constituent components of the heat-sensitive recording material of the invention are described. However, the invention is not limited thereto.

(Softening Agent, Sizing Agent, and Additives)

The (1) one kind of polyacrylamide or cationic starch is added to pulp slurry used in production of the base paper in the heat-sensitive recording material of the invention.

The polyacrylamide used in the invention is an additive generally called a paper strength agent, and includes anionic polyacrylamide, cationic polyacrylamide and amphoteric polyacrylamide.

The anionic polyacrylamide can be obtained by hydrolyzing polyacrylamide (nonionic polymer), which is obtained by converting an acrylamide monomer into a macro molecular compound by polymerization, partially in the presence of alkali, or by copolymerizing an acrylamide monomer with a sodium acrylate monomer.

The addition of the anionic polyacrylamide to the base paper is desirably performed by dispersing an aqueous solution of the anionic polyacrylamide homogeneously into a pulp slurry diluted with water while stirring the slurry. This anionic polyacrylamide is fixed into the pulp by adding a water-soluble aluminum salt and/or cationic polyacrylamide to the pulp slurry. The water-soluble aluminum salt used herein is preferably aluminum sulfate or aluminum chloride.

The cationic polyacrylamide can be obtained, for example, by copolymerizing acrylamide with a cationic monomer. Preferable examples of the cationic monomer copolymerized with the acrylamide include compounds represented by the following two structural formulae and salts thereof.

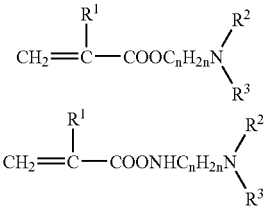

wherein $R^1$ represents a hydrogen atom or a lower alkyl group, $R^2$ and $R^3$ each independently represent a lower alkyl group, and n is an integer of 1 to 5.

Specific examples of the cationic monomer include dimethylaminoethyl methacrylate, diethylaminoethyl methacrylate, a methylchloride salt of dimethylaminoethyl methacrylate and dimethylaminopropylacrylamide. In the invention, a terpolymer obtained by adding (meth)acrylic acid to the acrylamide and the cationic monomer and then copolymerizing the components can be used.

The amphoteric polyacrylamide can be obtained, for example, by copolymerizing acrylamide or methacrylamide as a main monomer component with an anionic monomer and a cationic monomer. Examples of the anionic monomer include acrylic acid, methacrylic acid, and itaconic acid. Of these examples, itaconic acid is particularly preferable. Preferable examples of the cationic monomer copolymerized with (meth)acrylamide include dialkylaminoalkyl methacrylates represented by the structural formulae illustrated above and salts thereof, and dialkylaminoalkylacrylamides represented by the structural formula illustrated above and salts thereof.

The molecular weight of the polyacrylamide used in the invention is preferably 2,500,000 or more, more preferably 3,000,000 or more, and even more preferably from 3,000,000 to 10,000,000. The molecular weight is measured by gel permeation chromatography (GPC). If the molecular weight is less than 2,500,000, the effect of enhancing the paper strength may be insufficient. On the other hand, if the molecular weight is more than 10,000,000, the polyacrylamide has a high viscosity so as to be unsuitable for the production of the base paper.

The amount of the used polyacrylamide is preferably from 0.01 to 5.0% by mass, more preferably from 0.05 to 3.0% by mass of the bone dry pulp. If the amount of the used polyacrylamide is less than 0.01% by mass, the addition effect thereof may be small. On the other hand, if the amount is more than 5.0% by mass, the aggregating effect thereof is too strong so that the texture of the base paper may deteriorate.

The one kind of polyacrylamide or cationic starch described above is added to the pulp slurry used in production of the base paper of the invention.

The cationic starch used in the invention is also an additive which is generally called a paper strength agent. The cationic starch can be obtained by giving a cationic group to ordinary starch such as corn starch, potato starch, tapioca starch, wheat starch, rice starch, or sweet potato starch. Such a process for producing the cationic starch is known, and the cationic starch can easily be obtained by introducing one or more basic nitrogen compounds or groups selected from primary, secondary and tertiary amines and quaternary ammonium groups, into starch. In the invention, it is particularly preferable to use cationic starch obtained by using a tertiary amine or a quaternary ammonium group.

The amount of the used cationic starch is preferably from 0.01 to 5.0% by mass, more preferably from 0.05 to 3.0% by mass of the bone dry pulp. If the amount of the used cationic starch is less than 0.01% by mass, the effect for enhancing the paper strength may be small. If the amount is more than 5.0% by mass, the aggregating effect of the starch is too strong so that the starch damages the productivity of the base paper.

In the heat-sensitive recording material of the invention, the (2) at least one of an alkyl ketene dimer and an epoxidized fatty acid amide is used as a sizing agent for the base paper in order to improve the sizing property thereof and give the base paper a strong adhesive force to an adjacent layer thereto by flame treatment or the like.

The alkyl ketene dimer used as the sizing agent is preferably a compound represented by the following structural formula:

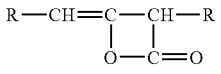

In the above formula, R represents an alkyl group, and the alkyl ketene dimer preferably has 8 to 30 carbon atoms, more preferably 12 to 20 carbon atoms, and most preferably 20 carbon atoms.

It is desirable to add the alkyl ketene dimer to a pulp slurry in the state that the alkyl ketene dimer, together with another sizing agent and/or a surfactant, is emulsified and dispersed. If the alkyl ketene dimer has less than 8 carbon atoms, the effect on the sizing property may be insufficient. On the other hand, if the alkyl ketene dimer has more than 30 carbon atoms, it may be difficult that the alkyl ketene dimer is emulsified and dispersed when it is used as the sizing agent. The added surfactant may be one selected appropriately from known surfactants.

The amount of the alkyl ketene dimer added is preferably from 0.05 to 5.0% by mass, more preferably from 0.1 to 3.0% by mass of the bone dry pulp used. If the amount of the alkyl ketene dimer added is less than 0.05% by mass, the effect on the sizing property may be insufficient. If the amount is more than 5.0% by mass, the paper strength may be lowered or staining may increase in the process.

Specific examples of the epoxidized fatty acid amide used as the sizing agent in the invention include amides obtained by condensation of a fatty acid and a polyamine as described in Japanese Patent Application Publication (JP-B) Nos. 38-20601 and 39-4507, and U.S. Pat. No. 3,692,092; and amides obtained by reaction of an alkenylsuccinic acid with a polyamine as described in JP-A No. 51-1705.

The epoxidized fatty acid amide used in the invention is preferably an epoxidized fatty acid amide represented by the following structural formula:

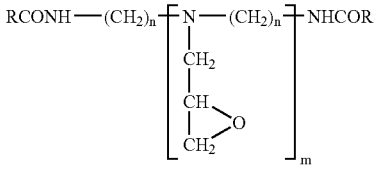

In the above formula, R represents an alkyl group having 2 to 30 carbon atoms, m is an integer from 1 to 10, and n is an integer from 2 to 5. It is particularly preferable to use epoxidized behenamide, epoxidized stearamide, or epoxidized myristic amide.

The amount of the epoxydized fatty acid amide added is preferably 0.05 to 5.0% by mass, more preferably 0.1 to 3.0% by mass, relative to the bone-dry pulp. When the amount is less than 0.05% by mass, the sizing effect may be insufficient, while when the amount is higher than 5.0% by mass, the paper strength may be decreased and staining in the process may be increased.

In the heat-sensitive recording material of the invention, the base paper of the support is made from pulp slurry containing the paper strength agent, the sizing agent etc., and is produced by coating or impregnating at least one face thereof with (3) at least one kind of softening agent.

As described above, the softening agent is used in a surface sizing solution for the produced base paper in the invention, but may be added to the pulp slurry. In this case, the softening agent added to the pulp slurry may be the same as or different from that the one used in the surface sizing solution. The amount of the softening agent added to the pulp slurry is not particularly limited, but is desirably regulated in such a range as to maintain desired paper strength.

The softening agent in (3) above used in the invention is not particularly limited, and examples include reaction products of a maleic anhydride copolymer and polyalkylenepolyamine, reaction products of a higher fatty acid and polyalkylenepolyamine, reaction products of urethane alcohol and an alkylating agent, quaternary ammonium salts of higher fatty acid, various surfactants such as nonionic surfactants and cationic surfactants, and polyamine-based compounds. Condensation products of fatty acid and polyamine as described in Japanese Patent Application Publication (JP-B) Nos. 38-20601, 39-4507 and U.S. Pat. No. 3,692,092, and reaction products of alkenylsuccinic acid and polyamine as described in Japanese Patent Application Laid-Open (JP-A) No. 51-1705, can also be utilized. The softening agent is described in detail in "Shin Kami Kako Binran" (New Paper Processing Handbook) (pp.554–555, published in 1980) compiled by Shiyaku Time.

Among those described above, the reaction products of a polyamine and a fatty acid having 8 to 40 carbon atoms are preferable as the softening agent used in the invention, from the viewpoint of improvement of the flatness of the base paper while maintaining the paper strength.

Preferable examples of the fatty acid having 8 to 40 carbon atoms include an aliphatic monocarboxylic acid and aliphatic polycarboxylic acid, and the number of carbon atoms therein is more preferably 8 to 30, still more preferably 12 to 25. The aliphatic monocarboxylic acid and aliphatic polycarboxylic acid include, for example, lauric acid, myristic acid, palmitic acid, palmitoleic acid, stearic acid, oleic acid, linoleic acid, linolenic acid, moroctic acid, arachidic acid, eicosenoic acid, arachidonic acid, eicosapentaenoic acid, behenic acid, erucic acid, docosapentaenoic acid, docosahexaenoic acid, arachic acid, tall oil fatty acid, alkylsuccinic acid, alkenylsuccinic acid etc. Among these, behenic acid, and stearic acid are preferable.

Preferable examples of the polyamine include polyalkylenepolyamines. Of these examples, polyalkylenepolyamines having 2 or 3 amino groups are preferable. Specific examples of the polyamine include diethylenetriamine, triethylenetetramine, tetraethylenepentamine, pentaethylenehexamine, dipropylenetriamine, tripropylenetetramine, and aminoethylethanolamine.

The amounts of the fatty acid and the polyamine in the reaction of the two are preferably set to such amounts that the number of the amino groups of the polyamine is made excessive over that of the carboxyl groups of the fatty acid. In order to make the epoxidized fatty acid amide as the sizing agent into fine particles at this time, the product obtained after the reaction of the fatty acid with the polyamine may be modified by reaction thereof with urea, adipic acid, maleic acid, phthalic acid, formic acid, formalin or the like if necessary. As described in JP-B Nos. 42-2922 and 45-28722 and JP-A No. 50-116705, when the fatty acid reacts with the polyamine, the reaction may be caused in the co-presence of rosin petroleum resin, rosin to which α,β-unsaturated polybasic acid is added, petroleum resin to which α,β-unsaturated polybasic acid is added, or the like to modify the resultant epoxidized fatty acid amide. The above-mentioned component used to modify the epoxidized fatty acid amide as the sizing agent is used as far as the whiteness, the sizing property, and other properties are not lowered.

To make the reaction product of the fatty acid and the polyamine water-soluble or water-dispersible, it is necessary as the case may be that the product is converted to a salt by use of an inorganic acid or an organic acid, or the product is modified by use of an alkyl halide, benzyl chloride, ethylene chlorohydrin, epichlorohydrin, ethylene oxide, or the like so as to be converted to a quaternary salt. The quaternary salt is desirable also for keeping cationic property in a wide pH range and preventing the sizing agent from dropping from the pulp by mechanical stirring. In this case, the sizing effect is particularly large when the product is converted to the quaternary salt by reaction thereof with epichlorohydrin.

The reaction product of polyamine and fatty acid having 8 to 40 carbon atoms used in the surface sizing solution for the produced base paper is applied in an amount (relative to dry pulp) of preferably not higher than 5.0% by mass, more preferably 3.0 to 0.1% by mass, onto the produced base paper. When the amount is higher than 5.0% by mass, the paper strength may be lowered.

As the softening agent used in the invention, various nonionic surfactants and cationic surfactants are also preferably used from the viewpoint of improving the flatness of the base paper while maintaining the paper strength.

The nonionic surfactants include polyethylene glycol type higher alcohol ethylene oxide adducts, alkyl phenol ethylene oxide adducts, fatty acid ethylene oxide adducts, polyhydric alcohol fatty acid ester ethylene oxide adducts, higher alkyl amine ethylene oxide adducts, fatty acid amide ethylene oxide adducts, fat and oil ethylene oxide adducts, polypropylene glycol ethylene oxide adducts, dimethyl siloxane-ethylene oxide block copolymers, dimethyl siloxane-(propylene oxide-ethylene oxide) block copolymers, and polyhydric alcohol type glycerol fatty acid esters, pentaerythritol fatty acid esters, sorbitol or sorbitan fatty acid esters, sucrose fatty esters, polyhydric alcohol alkyl ethers, and alkanol amine fatty acid amides.

Among these nonionic surfactants, the surfactants used in the surface sizing solution are particularly preferably polyhydric alcohol type nonionic surfactants such as polyhydric alcohol fatty acid ester ethylene oxide adducts, polyhydric alcohol glycerol fatty acid esters and polyhydric alcohol alkyl ethers. The nonionic surfactants may be used alone or as a mixture of two or more thereof.

The HLB (hydrophile-lipophile balance) of the nonionic surfactant described above is preferably 6 to 15, more preferably 6 to 13, still more preferably 6 to 1 1, from the viewpoint of stable solubility or suspension in water and improvement of wetting properties on produced pulp paper.

The cationic surfactant includes, for example, tetraalkyl ammonium salts, quaternary ammonium salts, alkylamine salts, benzalkonium salts, alkyl pyridium salts, imidazolium salts etc., and specifically, preferable examples include dihydroxyethyl stearylamine, 2-heptadecenyl-hydroxyethyl imidazoline, lauryldimethylbenzyl ammonium chloride, cetyl pyridinium chloride, stearamide methyl pyridinium chloride etc.

The nonionic or cationic surfactant used in the surface sizing solution is added in an amount of preferably 0.01 to 10% by mass, more preferably 0.03 to 5% by mass, still more preferably 0.05 to 3% by mass, relative to dry pulp. When the amount of the surfactant added is less than 0.01% by mass, the treatment solution may fail to confer sufficient wetting properties on the surface of produced pulp paper, while when the amount is higher than 10% by mass, there may arise a problem of inappropriate production due to the stability deterioration or foaming of the treatment solution.

As the softening agent used in the invention, a polyamine-based compound having two or more amino groups can also be preferably used.

The polyamine-based compound is preferably the one having two or more primary to tertiary amino groups. The compound containing two or more amino groups includes cyclic amino groups, polyamine-based compounds etc.

Examples of the polyamine-based compound include piperazine, 2-methyl piperazine, N,N-dihydroxymethyl piperazine, N,N-diaminoethyl piperazine, N-ethoxycarbonyl piperazine, N,N-dicarboxyethyl piperazine, homopiperazine, N-methyl homopiperazine, diethylene triamine, tetraethylene pentamine, polyallyl amine, polyvinyl amine etc.

As the polyamine-based compound, various allylamine polymers and derivatives thereof are preferably used. For example, polyallyl amine/acid salts (the acid includes inorganic acids such as hydrochloric acid, sulfuric acid, phosphoric acid and nitric acid, organic acids such as methanesulfonic acid, toluenesulfonic acid, acetic acid, propionic acid, cinnamic acid and (meth)acrylic acid, or combination thereof, or allylamine may be partially converted into a salt), derivatives of polyallylamine by polymerization (for example, polymers containing repeating structural units represented by the following formulae (1) to (5)) and copolymers of polyallylamine with other copolymerizable monomers (monomers including (meth)acrylates, styrene derivatives, (meth)acrylamides, acrylonitrile, vinyl esters etc.).

Formula (1)

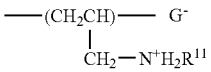

Formula (2)

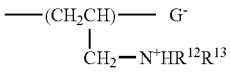

Formula (3)

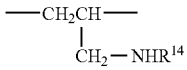

Formula (4)

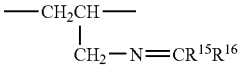

Formula (5)

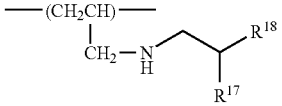

In the above formulae, $R^{11}$ to $R^{14}$ each represent an optionally substituted organic group, $R^{15}$ and $R^{16}$ independently represent an optionally substituted organic group (which is the same as $R^{11}$ to $R^{14}$) or a hydrogen atom. $R^{17}$ represents a hydrogen atom or a methyl group, and $R^{18}$ represents —$COOR^{19}$, —CN or —$CONR^{20}R^{21}$. $R^{19}$ to $R^{21}$ independently represent a hydrogen atom, an aliphatic group or an aromatic group. $G^-$ represents a counter anion.

The structure of these polyallylamine derivatives is not particularly limited, and the resulting polymer is preferably soluble in water or soluble in water-miscible organic solvents but can also be used in the form of water-dispersible latex particles.

Examples of the polyallylamine and derivatives thereof include compounds described in JP-B Nos. 62-31722, 2-14364, 63-43402, 63-43403, 63-45721, 63-29881, 1-26362, 2-56365, 2-57084, 4-41686, 6-2780, 6-45649, 6-15592, 4-68622, Japanese Patent Nos. 3199227 and 3008369, JP-A Nos. 10-330427, 11-21321, 2000-281728, 2001-106736, 62-256801, 7-173286, 7-213897, 9-235318, 9-302026, 11-21321, WO99/21901, WO99/19372, JP-A No. 5-140213 and Japanese Patent Application National Publication (Laid-Open) No. 11-506488, preferably polyvinylamine and polyallylamine, particularly preferably polyallylamine.

The amount of the polyamine-based compound applied onto the produced pulp base paper is preferably not higher than 5.0% by mass, more preferably 3.0 to 0.1% by mass, relative to dry pulp. When the amount is higher than 5.0% by mass, the paper strength may be lowered.

A surface sizing solution for the base paper is desirably an aqueous solution of polyvinyl alcohol and/or a modified product thereof. Besides, the following may be added to the base paper: a polymer compound such as starch, carboxymethylcellulose, hydroxyethylcellulose, sodium alginate, cellulose sulphate, gelatin or casein; a metal salt such as calcium chloride, sodium chloride, or sodium sulfate; an absorbent such as glycerin or polyethylene glycol; a colorant or a whitening agent such as a dye or a fluorescent whitening agent; a pH adjusting agent such as sodium hydroxide, ammonia water, hydrochloric acid, sulfuric acid, or sodium carbonate; a pigment, if necessary. In order to impregnate the base paper with one or more of these additives, it is desirable to impregnate or coat the paper therewith by means of a size press, tub size or gate roll coaster.

(Support)

A paper support is used as the support used in the heat-sensitive recording material of the invention. For a base paper used in this paper support, any one of coniferous tree pulp and hardwood pulp can be used. It is preferable to use hardwood pulp, which is made of short fibers and gives a high smoothness, in a relatively large amount. For example, it is preferable to set the content by percentage of hardwood pulp to 60% by mass or more of all pulp kinds which constitute the base paper. Specifically, the wood pulp may be any one of LBKP, LBSP, NBKP, NBSP, LDP, NDP, LUKP and NUKP. It is preferable to use LBKP, NBSP, LBSP, NDP or LDP, in which the content of short fibers is large, in a relatively large amount.

The above-mentioned pulp is preferably a chemical pulp (such as sulfate pulp or sulfite pulp), in which the content of impurities is small, and is most preferably a pulp having a whiteness improved by bleaching treatment.

For the paper support, the following may be used instead of the natural pulp: a synthetic pulp made of polyethylene, polypropylene or the like; or a synthetic fiber made of polyester, polyvinyl alcohol, nylon or the like. A mixture wherein the natural pulp and the synthetic pulp are mixed at an arbitrary ratio may be used.

The freeness of the used pulp material according to the CSF standard is from 150 to 500 mL, more preferably from 200 to 400 mL. The fiber length after beating is preferably set in such a manner that the (24+42) mesh residue regulated in JIS P8207 will be 40% by mass or less.

Usually, a sizing agent is added into the above-mentioned base paper. In the invention, the above-mentioned sizing agent is used at the specified content by percentage.

In general, a fixing agent for the sizing agent is added into the base paper. It is preferable to use a neutral or weakly alkaline fixing agent such as a sulfuric acid band (aluminum sulfate), cationic starch, polyamidepolyamine epichlorohydrin, polyacrylamide, or a polyacrylamide derivative, or add a sulfuric acid band and then neutralize the resultant with an alkali.

In order to improve the smoothness of the base paper, a filler can be added to the base paper. Examples of the filler include calcium carbonate, talc, clay, kaolin, titanium dioxide and urea resin fine particles.

As internal additive chemicals other than the above-mentioned internal additive sizing agent, fixing agent and filler, the following may be added into the base paper if necessary: a paper strength enhancing agent such as polyacrylamide, starch or polyvinyl alcohol; a product made from maleic anhydride copolymer and polyalkylpolyamine; a softening agent such as a quaternary ammonium salt of a higher fatty acid; a colored dye; a fluorescent dye; and so on.

The base paper used in the paper support of the invention can be produced by using materials as described above and a Fourdrinier paper machine or a cylinder paper machine. The basis weight of the base paper is preferably from 20 to 300 g/m$^2$, more preferably from 50 to 200 g/m$^2$. The thickness of the base paper is preferably from 25 to 350 μm, more preferably from 40 to 250 μm.

A high smoothness can be given to the base paper by subjecting the base paper material to calendar treatment during or after paper-making. The density of the base paper is generally from 0.7 to 1.2 g/cm$^3$ (according to JIS P-8118). The rigidity of the base paper is preferably from 20 to 200 g under conditions specified in JIS P-8143.

The surface of the support of the invention may be subjected to surface treatment such as corona discharge treatment, glow discharge treatment, flame treatment, or ultraviolet ray radiating treatment in order to improve the wettability and the adhesiveness thereof.

Since the basis weight of a base paper substrate is preferably from 60 to 170 g/m$^2$ and the heat-sensitive recording material is desired to have a high flatness, it is preferable that the smoothness and the flatness of the surface are excellent. It is therefore preferable that the surface is treated by the application of heat and pressure thereto by means of a machine calendar, a soft calendar, a super calendar or the like.

In the base paper used in the invention, the internal bond strength thereof regulated in JAPAN TAPPI paper pulp test method No. 18-2 is preferably from 0.8 to 1.5 kgf·cm, more preferably from 0.9 to 1.4 kgf·cm, most preferably from 1.0 to 1.3 kg·cm in at least one direction selected from the lengthwise direction and the lateral direction of the base paper. If the internal bond strength of the base paper is less than 0.8 kgf·cm, the mechanical strength of the base paper is insufficient so that the paper is not easily made or processed. Moreover, the runnability of the paper in a printer may be poor when a color is developed on the heat-sensitive recording material. On the other hand, if the internal bond strength of the base paper is more than 1.5 kgf·cm, the smoothness of the base paper is poor. Thus, when a resin coating layer is formed on this base paper, the smoothness of the resin layer surface is also poor. Consequently, a heat-sensitive recording layer surface formed thereon is also poor in smoothness. Accordingly, a thermal head does not touch the recording layer evenly, so as to generate an uneven image. If the internal bond strength of the base paper is more than 1.5 kgf·cm, the compressibility of the base paper in the thickness direction becomes small so as to reduce the compressibility, in the thickness direction, of a sheet substrate on which resin layers are formed on both surfaces of the base paper and further the compressibility of a heat-sensitive recording material wherein heat-sensitive recording layers are formed on the resin layers. Consequently, a thermal head does not touch the heat-sensitive recording layer evenly, so as to give an uneven image quality.

On the other hand, when the internal bond strength of the base paper in the invention, defined in JAPAN TAPPI paper pulp test method No. 18-2, is from 0.8 to 1.5 kgf·cm, in particular, from 0.9 to 1.4 kgf·cm in at least one of the directions, no troubles are caused against the making or processing of the paper or the runnability of the product to be obtained in a printer and further a well uniform recorded image can be obtained. From these viewpoints, the internal bond strength of the base paper in the invention, defined in JAPAN TAPPI paper pulp test method No. 18-2, is preferably from 0.8 to 1.5 kgf·cm.

In order to control the internal bond strength of the base paper as described above, it is desirable to select the kind of pulp and further soften the pulp by beating, so as to adjust the Canadian freeness value thereof. The Canadian freeness value represents the freeness of pulp slurry, and further represents the fibrillation of fibers or the shortening of fibers.

As the Canadian freeness value is smaller, the beating of the fibers advances further and the internal bond strength becomes larger within a certain range. The adjustment of the content by percentage of the chemicals added to the pulp makes it possible to adjust the internal bond strength. For example, as the amount of the added sizing agent such as the epoxidized fatty acid amide, the alkyl ketene dimer or the fatty acid salt is larger, the internal bond strength is smaller. On the other hand, as the amount of the added paper strength enhancing agent such as the polyacrylamide is larger, the internal bond strength is larger. Accordingly, the internal bond strength can be adjusted to a desired value by adjusting the amounts of these added chemicals.

The base paper of the heat-sensitive recording material used in the invention preferably has an optical contact ratio (Rp) of 7 μm or less, the optical contact ratio being measured while the base paper is pressed at a pressure of 5 kg/cm$^2$. The base paper having an optical contact ratio (Rp) of more than 7 μm may be insufficient in flatness for a support on which a heat-sensitive recording layer is formed. Thus, in order to set the three dimensional surface roughness to a desired value (for example, 0.25 μm) or less by coating the base paper with a polyolefin resin as described below, it is necessary to increase the thickness of the resin coating. Accordingly, this base paper is not desired. The value of the optical contact ratio (Rp) is more preferably 6 μm or less, most preferably 5 μm or less.

The value of the optical contact ratio (Rp) is the average value of five values obtained by using a surface tester "Micro Topograph" manufactured by Toyo Seiki Seisaku-Sho, Ltd. to measure the optical contact ratio of a sample 5 times in the state that the sample is pressed with a pressing contacter having a diameter of 5.5 cm at a pressure of 5 kg/cm$^2$ for a contacting time of 990 ms.

In the invention, a polyolefin resin layer is preferably formed on at least a face on a recording side of the base paper. The polyolefin resin layer may be formed by coating the base paper with a polyolefin resin by melt extrusion, or a resin layer formed by dry laminating, that is, a resin layer obtained by bonding a resin film which is beforehand molded onto the base paper with an adhesive agent or the like. The resin layer with which the base paper is coated is preferably the resin layer formed by the melt extrusion coating.

Examples of the polyolefin resin used in the melt extrusion coating onto the base paper include homopolymers and copolymer of α-olfein, such as polyethylene, polypropylene and polyvinyl chloride, and mixtures of these polymers. Particularly preferable examples of the polyolefin resin are high-density polyethylene, low-density polyethylene and a blend thereof. These polyolefin resins may be applied onto the base paper surface by melt extrusion. Accordingly, the molecular weight thereof is not particularly limited as far as the resins can undergo melt extrusion coating. Usually, a polyolefin resin having a molecular weight of $10^4$ to $10^6$ is preferably used.

In the case of bonding a resin film which is beforehand molded to the base paper with an adhesive agent or the like to the base paper, examples of the olefin resin include homopolymers and copolymer of α-olefin, such as polyethylene and polypropylene, and mixtures of these polymers.

When a resin layer is formed, as a back layer, on the face of the base paper opposite to the face thereof on which the heat-sensitive recording layer is formed, a curl balance of the sheet substrate can be kept good. If the curl balance of the sheet substrate is bad, this bad curl balance produces an effect on the curl obtained after a coating solution for the heat-sensitive recording layer is applied and dried. Consequently, a bad effect is produced on the paper-feeding ability or the runnability of the resultant heat-sensitive recording material in a printer.

In the heat-sensitive recording material of the invention, the resin layer on the support is formed on at least the front face of the support, that is, the face thereof which has the heat-sensitive recording layer. The resin layers may be formed on both faces of the support, or the resin layer may be formed on only the face of the support on which the heat-sensitive recording layer is formed. The resin layer on the side of the face onto which the heat-sensitive recording layer is applied preferably contains a white pigment. The kind of the white pigment and the blend amount thereof can be appropriately selected from known ones. Furthermore, known additives such as fluorescent whitening agent and an antioxidant can be added thereto. Examples of the incorporated white pigment include titanium dioxide, barium sulfate, barium carbonate, calcium carbonate, lithopone, alumina white, zinc oxide, silica antimony trioxide, and titanium phosphate. These may be used alone or in a mixture form. Of these pigments, titanium dioxide and zinc oxide are particularly preferable from the viewpoints of whiteness, dispersibility and stability.

The titanium dioxide may be of a rutile type or an anatase type. These may be used alone or in a mixture form. The titanium oxide may be produced by the sulfuric acid method or the chloride method. As such titanium dioxide, the following can be appropriately used: titanium dioxide subjected to surface coating treatment with an inorganic material, such as anhydrous alumina treatment, anhydrous silicon dioxide treatment, or zinc oxide treatment; titanium dioxide subjected to surface coating treatment with an organic material such as trimethylolpropane, trimethylolethane, trimethylolpropane, or 2,4-dihydroxy-2-methylpentane; titanium dioxide treated with a siloxane such as polydimethylsiloxane; or the like. The amount of the white pigment incorporated into the polyolefin resin, which is varied dependently on the kind of the used white pigment and the thickness of the resin layer, is usually selected from the range of 5 to 20% by mass. The machine or instrument used when a thermoplastic resin such as polyolefin is subjected to extrusion coating is preferably an ordinary polyolefin extruder or laminator.

About the thickness of the resin layers with which the base paper is coated, the thickness of the resin layer on the side of the face on which the heat-sensitive recording layer is formed (i.e., the front face side) is desirably made larger than that of the resin layer on the side of the face on which no heat-sensitive recording layer is formed (i.e., the rear face side). The resin layer on the front face side produces an effect on the surface roughness of the sheet substrate. From this viewpoint, the thickness of the resin layer on the front face side is preferably set to 10 to 80 μm. If the thickness of the resin layer on the front face side is less than 10 μm or is more than 80 μm, extrusion-laminating for forming this layer cannot be stably performed at a high speed so that the surface roughness of the sheet substrate may unfavorably deteriorate.

Since a change is easily generated in the resin layer on the front face side by heat of the sheet substrate at the time of heat-sensitive recording, it is desirable to use a resin having a relatively high melting point in this resin layer. Specifically, the melting point of the used resin is preferably 80° C.

or higher, more preferably 100° C. or higher, and even more preferably 105° C. or higher. If a resin having a melting point below 80° C. is used, the resin layer is changed by receiving heat from a thermal head at the time of heat-sensitive recording. As a result, the surface roughness of the sheet substrate may unfavorably deteriorate.

In order to reinforce the bonding between the base paper and the resin coating layer, it is preferable to subject the base paper to surface treatment before the extrusion coating of the resin layer onto the base paper. Examples of this surface treatment include acid etching treatment with a mixed liquid of sulfuric acid and chromic acid, flame treatment with gas flame, ultraviolet ray radiating treatment, corona discharge treatment, glow discharge treatment, and anchor coat treatment with alkyl titanate. In accordance with purpose, an appropriate treatment can be selected. The corona treatment is particularly convenient since the treatment is simple and easy. In the case of the corona treatment, it is preferable to continue the treatment until the contact angle of the surface with water gets to 70° or less.

As the anchor coat agent, an organic titanium type, isocyanate (urethane) type, polyethyleneimine type, polybutadiene type or some other type agent is well known. Specific examples of the organic titanium type agent include alkyl titanates such as tetraisopropyl titanate, tetrabutyl titanate and tetrastearyl titanate; titanium acylates such as butoxytitanium stearate; and titanium chelates such as titanium acetylacetonate. Examples of the isocyanate (urethane) type agent include toluene diisocyanate (TDI), diphenylmethane diisocyanate (MDI), hexamethylene diisocyanate (HMDI), xylylene diisocyanate (XDI) and isophorone diisocyanate (IPDI).

In the heat-sensitive recording material of the invention, the three dimensional surface roughness of the resin coating layer on the front face side of the support is preferably 0.25 μm or less under a filter wavelength condition of 1.0 to 2.0 mm (cutoff condition: wavelengths of 1 mm or less and 2 mm or more). The three dimensional surface roughness is more preferably 0.23 μm or less, most preferably 0.20 μm or less in order to improve the quality of images obtained by heat-sensitive recording.

The three dimensional surface roughness means center face average roughness (SRa). This center face average roughness (SRa) is defined as a value (unit: μm) given by the following numerical formula at the time of pulling out, from a rough curved surface, a portion having an area SM over the center face thereof, putting rectangular coordinate axes, X and Y axes, over the center face of this pulled-out portion, and then putting an axis crossing the center face at right angles as a Z axis:

$$SRa = \frac{1}{SM}\int_0^{LX}\int_0^{LY}|f(X, Y)|dx, dy$$

wherein LX×LY=SM, and Z=f(X, Y).

This center face average roughness (SRa) is measured using a surface shape measuring device "Nanometro 110F" manufactured by Kuroda Precision Industries Ltd. under the following measuring and analyzing conditions:

Scanning direction: MD direction of a sample

Measurement length: 50 mm in the X direction, and 30 mm in the Y direction

Measurement pitch: 0.1 mm in the X direction, and 0.1 mm in the Y direction

Scanning speed: 30 mm/second

Band pass filter: 1 to 2 mm (cutoff: 1 mm or less and 2 mm or more)

Filter inclination: −12 dB/Oct

Effective range of the filter inclination: up to half wavelength, 0.5 mm, in a short wavelength area, and up to double wavelength, 4 mm, in a long wavelength area If the three dimensional surface roughness defined above is more than 0.25 μm, the smoothness of the surface of the heat-sensitive recording layer formed on the resin layer is poor. Consequently, at the time of heat-sensitive recording, a thermal head does not touch the heat-sensitive recording layer surface evenly, so as to give an uneven image, in which density unevenness is generated.

When an image is recorded, the front face side of the sheet substrate receives heat from the thermal head. By the effect of this heat, the flatness of the front face side of the sheet substrate is deteriorated, so that the heat-sensitive recording layer deteriorates. Therefore, it is preferable that a surface roughness of the sheet substrate before the heat-sensitive recording is set to 0.25 μm or less so that the surface roughness of the sheet substrate after the heat-sensitive recording becomes 0.4 μm or less, and more preferably 0.35 μm or less, as a center face average roughness (Sra).

In order to improve the adhesiveness between the resin layer made of polyolefin or the like and the heat-sensitive recording layer formed thereon by coating, the surface of the resin layer may be subjected to surface treatment such as corona discharge treatment. After the surface of the resin layer is subjected to corona discharge treatment, an undercoat layer made mainly of gelatin is formed thereon.

The top face opposite to the face of the base paper on which the heat-sensitive recording layer is formed, that is, the surface of the polyethylene (polyolefin) layer on the rear side is usually a mat face. If necessary, an antistatic layer containing an ionic organic antistatic agent (such as an alkali metal salt of a polymerizable carboxylic acid), colloidal silica, or the like can be formed on the polyethylene layer on the rear side.

A back coating layer may be formed on the support used in the recording material of the invention. Examples of a component which can be added to this back coating layer include a white pigment, an aqueous binder, and others.

Examples of the white pigment contained in the back coating layer include white inorganic pigments such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo-boehmite, aluminum hydroxide, alumina, lithopone, zeolite, hydrated halloysite, magnesium carbonate, and magnesium hydroxide; and organic pigments such as styrene type plastic pigment, acrylic type plastic pigment, polyethylene, microcapsules, urea resin, and melamine resin.

Examples of the aqueous binder used in the back coating layer include water-soluble polymers such as styrene/maleate copolymer, styrene/acrylate copolymer, polyvinyl alcohol, silanol-modified polyvinyl alcohol, starch, cationic starch, casein, gelatin, carboxymethylcellulose, hydroxyethylcellulose, and polyvinyl pyrrolidone; and water-dispersible polymers such as styrene/butadiene latex, and acrylic emulsion.

As other components, the following can be incorporated into the back coating layer: an antifoaming agent, a foam suppresser, a dye, a fluorescent whitening agent, a preservative, and a water resisting agent.

(Heat-Sensitive Recording Layer)

The heat-sensitive recording material of the invention has a heat-sensitive recording layer in which a color can be developed by heat. In the case that the heat-sensitive recording material is a material for forming a multicolored image, the material has at least two heat-sensitive recording layers wherein colors different from each other can be developed by heat and pressure. In particular, in heat-sensitive recording materials for multicolor, energies supplied to different heat-sensitive recording layers are caused to have differences therebetween, thereby developing desired colors; therefore, when an image is recorded at a high printing energy, the occurrence of blisters becomes remarkable. However, in the recording material of the invention, the occurrence of blisters can be suppressed by the effect of gas (water vapor) permeation suppression of the above-mentioned undercoat layer according to the invention. Consequently, the image quality of the multicolored image can be kept satisfactory.

An example of the heat-sensitive recording material for multicolor is a heat-sensitive recording material wherein a full-color image can be formed by making heat-sensitive recording layers each of which can develop cyan, magenta, or yellow. About the heat-sensitive recording material for multicolor, structure examples and a recording method described in JP-A No. 11-34495, columns 36 to 38 can be applied to the heat-sensitive recording material of the invention.

The heat-sensitive recording layer preferably contains a color forming component which is colorless at ambient temperature and undergoes color-developing reaction by receiving heat. Examples of the color forming component include the following combinations (a) to (r):

(a) a combination of an electron-donating dye precursor and an electron-accepting compound;

(b) a combination of a diazo compound and a coupling component (hereinafter referred to as a "coupler compound" as the case may be);

(c) a combination of a metal salt of an organic acid, such as silver behenate or silver stearate, and a reducing agent such as protocatechinic acid, spiroindane or hydroquinone;

(d) a combination of an iron salt of a long chain fatty acid, such as ferric stearate or ferric myristate, and a phenol compound such as tannic acid, gallic acid or ammonium salicylate;

(e) a combination of a heavy metal salt of an organic acid, such as a nickel, cobalt, lead, copper, iron, mercury or silver salt of acetic acid, stearic acid or palmitic acid, and a sulfide of an alkali metal or alkali earth metal, such as calcium sulfide, strontium sulfide, or potassium sulfide, or a combination of the heavy metal salt of an organic acid and an organic chelating agent such as s-diphenylcarbazide, or diphenylcarbazone;

(f) a combination of a heavy metal sulfate such as a silver, lead, mercury or sodium salt of sulfuric acid, and a sulfur compound such as sodium tetrathionate, sodium thiosulfate, or thiourea;

(g) a combination of a ferric salt of a fatty acid such as ferric stearate, and an aromatic polyhydroxy compound such as 3,4-hydroxytetraphenylmethane;

(h) a combination of a metals salt of an organic acid such as silver oxalate or mercury oxalate, and an organic polyhydroxy compound such as polyhydroxy alcohol, glycerin or glycol;

(i) a combination of a ferric salt of a fatty acid such as ferric pelargonate or ferric laurate, and a thiocetylcarbamide or isothiocetylcarbamide derivative;

(j) a combination of a lead salt of an organic acid, such as lead caprate, lead pelargonate, or lead behenate, and a thiourea derivative such as ethylenethiourea or N-dodecylthiourea;

(k) a combination of a heavy metal salt of higher fatty acid such as ferric stearate or copper stearate, and zinc dialkyldithiocarbamate;

(l) a combination which can form an oxazine dye, such as a combination of resorcinol and a nitroso compound;

(m) a combination of a formazan compound and a reducing agent and/or a metal salt;

(n) a combination of a protected dye (or leuco dye) precursor and a de-protecting agent;

(o) a combination of an oxidizable color former and an oxidizer;

(p) a combination of a phthalonitrile compound and a diiminoisoindoline compound (i.e., a combination which can generate a phthalocyanine);

(q) a combination of an isocyanate compound and a diiminoisoindoline compound (i.e., a combination which can generate a colored pigment); and (r) a combination of a pigment precursor and an acid or a base (i.e., a combination which can generate a pigment).

The above-mentioned color forming component is preferably the combination (a) of an electron-donating dye precursor and an electron-accepting compound or the combination (b) of a diazo compound and a coupling component.

(Electron-Donating Dye Precursor)

Examples of the electron-donating dye precursor in the combination (a) include phthalide compounds, fluorane compounds, phenothiazine compounds, indolylphthalide compounds, leuco auramine compounds, rhodamine lactam compounds, triphenylmethane compounds, triazene compounds, spiropyran compounds, pyridine compounds, pyrazine compounds, and fluorene compounds.

Examples of the phthalide compounds include the compound described in U.S. Pat No. Re 23,024, and U.S. Pat. Nos. 3,491,111, 3,491,112, 3,491,116, and 3,509,174. Specific examples thereof include 3,3-bis(p-dimethylaminophenyl)-6-dimethylaminophthalide, 3,3-bis(p-dimethylaminophenyl)phthalide, 3-(p-dimethylaminophenyl)-3-(1,3-dimethylindole-3-yl)phthalide, and 3-(p-dimethylaminophenyl)-3-(2-methylindole -3-yl)phthalide.

Examples of the fluorane compounds include compounds described in U.S. Pat. Nos. 3,624,107, 3,627,787, 3,641,011, 3,462,828, 3,681,390, 3,920,510 and 3,959,571. Specific examples thereof include 2-(dibenzylamino)fluorane, 2-anilino-3-methyl-6-diethylaminofluorane, 2-anilino-3-methyl-6-dibutylaminofluorane, 2-anilino-3-methyl-6-N-ethyl-N-isoamylaminofluorane, 2-anilino-3-methyl-6-N-methyl-N-cyclohexylaminofluorane, 2-anilino-3-chloro-6-diethylaminofluorane, 2-anilino-3-methyl-6-N-ethyl-N-isobutylaminofluorane, 2-anilino-6-dibutylaminofluorane, 2-anilino-3-methyl-6-N-methyl-N-tetrahydrofurfurylaminofluorane, 2-anilino-3-methyl-6-pyperidinoaminofluorane, 2-(o-chloroanilino)-6-diethylaminofluorane, and 2-(3,4-dichloroanilino)-6-diethylaminofluorane.

Examples of the thiazine compounds include benzoyl leuco methylene blue, and p-nitrobenzyl leuco methylene blue.

Examples of the leuco auramine compounds include 4,4'-bis-dimethylaminobenzhydrin benzyl ether, N-halophenyl-leuco auramine, and N-2,4,5-trichlorophenyl leuco auramine.

Examples of the rhodamine lactam compounds include rhodamine-B-anilinolactam, and rhodamine-(p-nitrino)lactam.

Examples of the spiropyran compounds include compounds described in U.S. Pat. No. 3,971,808. Specific examples thereof include 3-methyl-spiro-dinaphthopyran, 3-ethyl-spiro-dinaphthopyran, 3,3'-dichloro-spiro-dinaphthopyran, 3-benzylspiro-dinaphthopyran, 3-methyl-naphto-(3-methoxy-benzo)spiropyran, and 3-propyl-spiro-dibenzopyran.

Examples of the pyridine compounds and the pyrazine compounds include compounds described U.S. Pat. Nos. 3,775,424, 3,853,869, and 4,246,318.

Examples of the fluorene compounds include compounds described in, for example, JP-A No. 63-94878.

The dye precursors, which can develop cyan, magenta and yellow may be various dye precursors described in, for example, U.S. Pat. No. 4,800,149. Further, the electron-donating dye precursors for yellow color developing dyes may be dye precursors described in, for example, U.S. Pat. No. 4,800,148. The electron-donating dye precursors for cyan color forming dyes may be dye precursors described in, for example, JP-A No. 63-53542.

(Electron-Accepting Compound)

The electron-accepting compounds used in the combination (a) may be known electron-accepting compounds, examples of which include phenol derivatives, salicylic acid derivatives, metal salts of aromatic carboxylic acids, acid clay, bentonite, novolak resin, metal-treated novolak resin, and metal complexes. Specific examples thereof are described in, for example, JP-B Nos. 40-9309 and 45-14039, and JP-A Nos. 52-140483, 48-51510, 57-210886, 58-87089, 59-11286, 60-176795, and 61-95988.

Of the above-mentioned compounds, examples of the phenol derivatives include 2,2'-bis(4-hydroxyphenyl)propane, 4-t-butylphenol, 4-phenylphenol, 4-hydroxydiphenoxide, 1,1'-bis(3-chloro-4-hydroxyphenyl)cyclohexane, 1,1'-bis(4-hydroxyphenyl)cyclohexane, 1,1'-bis(3-chloro-4-hydroxyphenyl)-2-ethylbutane, 4,4'-sec-isooctylidenediphenol, 4,4'-sec-butylidenediphenol, 4-tert-octylphenol, 4-p-methylphenylphenol, 4,4'-methylcyclohexylidenephenol, 4,4'-isopentylidenephenol, and benzyl p-hydroxybenzoate.

Examples of the salicylic acid derivative include 4-pentadecylsalicylic acid, 3,5-di(a-methylbenzyl) salicylic acid, 3,5-di(tert-octyl)salicylic acid, 5-octadecyl salicylic acid, 5-α-(p-α-methylbenzylphenyl)ethylsalicylic acid, 3-α-methylbenzyl-5-tert-octylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, and zinc, aluminum, calcium, copper and lead salts thereof.

In the case that the combination (a) of an electron-donating dye precursor and an electron-accepting compound is used as the color forming components, the electron-donating dye precursor is preferably incorporated into the heat-sensitive recording layer in an amount of 0.1 to 5 g/m$^2$, more preferably 0.1 to 1 g/m$^2$. The electron-accepting compound is preferably used in an amount of 0.5 to 20 parts by mass, more preferably 3 to 10 parts by mass, per part by mass of the used electron-donating dye precursor. If the amount is less than 0.5 part by mass, a sufficient color density cannot be obtained. If the amount is more than 20 parts by mass, the sensitivity unfavorably drops or the coatability unfavorably deteriorates.

(Diazo Compound)

The diazo compound which can be used in the combination (b) is preferably a compound represented by the following formula:

$$Ar—N_2^+ \cdot Y^-$$

wherein Ar represents an aromatic ring group and $Y^-$ represents an acid anion.

In the formula, Ar represents a substituted or unsubstituted aryl group. Examples of the substituent include an alkyl, alkoxy, alkylthio, aryl, aryloxy, arylthio, acyl, alkoxycarbonyl, carbamoyl, carboamide, sulfonyl, sulfamoyl, sulfonamide, ureido, halogen, amino, and heterocyclic group. These substituents may further be substituted.

The aryl group is preferably an aryl group having 6 to 30 carbon atoms, examples of which include a phenyl, 2-methylphenyl, 2-chlorophenyl, 2-methoxyphenyl, 2-butoxyphenyl, 2-(2-ethylhexyloxy)phenyl, 2-octyloxyphenyl, 3-(2,4-di-tert-pentylphenoxyethoxy)phenyl, 4-chlorophenyl, 2,5-dichlorophenyl, 2,4,6-trimethylphenyl, 3-chlorophenyl, 3-methylphenyl, 3-methoxyphenyl, 3-butoxyphenyl, 3-cyanophenyl, 3-(2-ethylhexyloxy)phenyl, 3,4-dichlorophenyl, 3,5-dichlorophenyl, 3,4-dimethoxyphenyl; 3-(dibutylaminocarbonylmethoxy)phenyl, 4-cyanophenyl, 4-methylphenyl, 4-methoxyphenyl, 4-butoxyphenyl, 4-(2-ethylhexyloxy)phenyl, 4-benzylphenyl, 4-aminosulfonylphenyl, 4-N,N-dibutylaminosulfonylphenyl, 4-ethoxycarbonylphenyl, 4-(2-ethylhexylcarbonyl)phenyl, 4-fluorophenyl, 3-acetylphenyl, 2-acetylaminophenyl, 4-(4-chlorophenylthio)phenyl, 4-(4-methylphenyl)thio-2,5-butoxyphenyl, and 4-(N-benzyl-N-methylamino)-2-dodecyloxycarbonylphenyl group. These groups may further be substituted with an alkyloxy, alkylthio, substituted phenyl, cyano, substituted amino, heterocyclic group, a halogen atom or the like.

Examples of the diazo compound that can be preferably used as the color forming component include diazo compounds described in JP-A No. 07-276808, paragraphs 44 to 49.

The maximum absorption wavelength $\lambda_{max}$ of the diazo compound is preferably 450 nm or less, more preferably from 290 to 440 nm. It is also preferable that the diazo compound has 12 or more carbon atoms, a solubility of 1% or less in water, and a solubility of 5% or more in ethyl acetate.

In the invention, the diazo compounds may be used alone or in combination of two or more thereof in accordance with purpose, for example, the adjustment of hue.

(Coupler Compound)

The coupler compound used in the combination (b) is a compound which is coupled with the diazo compound in a basic atmosphere and/or a neutral atmosphere, so as to form a dye. A plurality of the couplers may be used in accordance with purpose, for example, the adjustment of hue. Preferable examples of the coupler compound include a coupler made of an active methylene compound having a methylene group adjacently to a carbonyl group, a phenol derivative, a naphthol derivative, or the like. Specific examples thereof include resorcinol, phloroglucinol, 2,3-dihydroxynaphthalene, sodium 2,3-dihyroxynaphthalene-6-sulfonate, 1-hydroxy-2-naphthoic morpholinopropylamide, sodium 2-hydroxy-3-naphthalenesulfonate, 2-hydroxy-3-naphthalenesulfonic anilide, 2-hydroxy-3-naphthalenesulfonic morpholinopropylamide, 2-hydroxy-3-naphthalenesulfonic acid-2-ethylhexyloxypropylamide, 2-hydroxy-3-naphthalenesulfonic acid-2-ethylhexylamide, 5-acetoamide-1-naphthol;

sodium 1-hydroxy-8-acetoamidenaphthalene-3,6-disulfonate, 1-hydroxy-8-acetoamidenaphthalene-3,6-disulfonic dianilide, 1,5-dihydroxynaphthalene, 2-hydroxy-3-naphthoic morpholinopropylamide, 2-hydroxy-3-naphthoic octylamide, 2-hydroxy-3-naphthoic anilide, 5,5-dimethyl-1,3-cyclohexanedione, 1,3-cyclopentanedione, 5-(2-n-tetradecyloxyphenyl)-1,3-cyclohexanedione, 5-phenyl-4-methoxycarbonyl-1,3-cyclohexanedione, 5-(2,5-di-n-octyloxyphenyl)-1,3-cyclohexanedione, N,N'-dicyclohexylbarbituric acid, N,N'-di-n-dodecylbarbituric acid;

N-n-octyl-N'-n-octadecylbarbituric acid, N-phenyl-N'-(2,5-di-n-octyloxyphenyl)barbituric acid, N,N'-bis(octadecyloxycarbonylmethyl)barbituric acid, 1-phenyl-3-methyl-5-pyrazolone, 1-(2,4,6-trichlorophenyl)-3-anilino-5-pyrazlone, 1-(2,4,6-trichlorophenyl)-3-benzamide-5-pyrazolone, 6-hydroxy-4-methyl-3-cyano-1-(2-ethylhexyl)-2-pyridone, 2,4-bis-(benzoylacetoamide)toluene, 1,3-bis(pivaloylacetoamidemethyl)benzene, benzoylacetonitrile, thenoylacetonitrile, acetoacetoanilide, benzoylacetoanilide, pivaloylacetoanilide, 2-chloro-5-(N-n-butylsulfamoyl)-1-pivaloylacetoamidebenzene, 1-(2-ethylhexyloxypropyl)-3-cyano-4-methyl-6-hydroxy-1,2-dihydropyridine-2-one, 1-(dodecyloxypropyl)-3-acetyl-4-methyl-6-hydroxy-1,2-dihydropyridine-2-one, and 1-(4-n-octyloxyphenyl)-3-tert-butyl-5-aminopyrazole.

About details of the above-mentioned coupler compound, the following can be referred to: JP-A Nos. 4-201483, 7-23367, 7-223368, 7-323660, 5-278608, 5-297024, 6-18669, 6-18670, 7-316280, 9-216468, 9-216469, 9-319025, 10-035113, 10-193801, 10-264532, and so on.

In the case that the combination (b) of a diazo compound and a coupler compound is used as the color forming components, the diazo compound is preferably incorporated into the heat-sensitive recording layer in an amount of 0.02 to 5.0 g/m$^2$, more preferably 0.05 to 3.0 g/m$^2$. If the amount is less than 0.02 g/m$^2$, a sufficient color density cannot be obtained. If the amount is more than 5.0 g/m$^2$, the coatability unfavorably deteriorates. The coupler compound is preferably used in an amount of 0.5 to 20 parts by mass , more preferably 1 to 10 parts by mass, per part by mass of the diazo compound. If the amount is less than 0.5 part by mass, a sufficient color forming property cannot be obtained. If the amount is more than 20 parts by mass, the coatability unfavorably deteriorates.

The coupler compound (together with any other component that may be added if desired) can be used in the state that a product obtained by adding a water-soluble polymer to the coupler compound and is solid-dispersed by means of a sand mill or the like. The compound can also be emulsified together with a suitable emulsifying auxiliary, so as to be able to be used as an emulsion. The method for the solid-dispersion or the emulsification is not particularly limited, and may be a known method. Details of this method are described in JP-A Nos. 59-190886, 2-141279, and 7-17145.

(Organic Base)

To promote the coupling reaction between the diazo compound and the coupler, it is preferable to use an organic base selected from tertiary amines, piperidines, piperazines, amidines, formamidines, pyridines, guanidines, morpholines, and others. Specific examples of the organic base include piperizines such as N,N'-bis(3-phenoxy-2-hydroxypropyl)piperazine, N,N'-bis[3-(p-methylphenoxy)-2-hydroxypropyl]piperazine, N,N'-bis[3-(p-methoxyphenoxy)-2-hydroxypropyl]pipedazine, N,N'-bis(3-phenylthio-2-hydroxypropyl)piperazine, N,N'-bis[3-(β-naphthoxy)-2-hydroxypropyl]piperazine, N-3-(β-naphthoxy)-2-hydroxypropyl-N'-methylpiperazine;

1,4-bis{[3-(N-methylpiperazino)-2-hydroxy]propyloxy}benzene; morpholines such as N-[3-(β-naphthoxy)-2-hydroxy]propylmorpholine, 1,4-bis[(3-morpholino-2-hydroxy)propyloxy]benzene, and 1,3-bis[(3-morpholino-2-hydroxy)propyloxy]benzene; piperidines such as N-(3-phenoxy-2-hydroxypropyl)piperidine, and N-dodecylpiperidine; triphenylguanidine, tricyclohexylguanide, dicyclohexylphenylguanidine, 2-N-methyl-N-benzylaminoethyl 4-hydroxybenzoate, 2-N,N-di-n-butylaminoethyl 4-hydroxybenzoate, 4-(3-N,N-dibutylaminopropoxy)benzenesulfonamide, and 4-(2-N,N-dibutylaminoethoxycarbonyl)phenoxyacetoamide.

These organic bases may be used alone or in combination of two or more thereof.

The organic bases are described in, for example, JP-A Nos. 57-123086, 60-49991, 60-94381, 9-71048, 9-77729 and 9-77737.

The amount of the used organic base is not particularly limited, and is preferably from 1 to 30 moles per mole of the diazo compound.

In order to promote the color-developing reaction, a color forming auxiliary may be added to the heat-sensitive recording layer.

Examples of the color forming auxiliary include phenol derivatives, naphthol derivatives, alkoxy-substituted benzenes, alkoxy-substituted naphthalenes, hydroxy compounds, carboxylic acid amide compounds, and sulfonamide compounds.

The heat-sensitive recording layer may contain a binder together with the color forming component. The binder is generally a water-soluble binder. Examples thereof include polyvinyl alcohol, hydroxyethylcellulose, hydroxypropylcellulose, ethylene/maleic anhydride copolymer, styrene/maleic anhydride copolymer, isobutylene/maleic anhydride copolymer, polyacrylic acid, starch derivatives, casein and gelatin. In order to give water resistance to the binder, the following may be added: a water resisting agent (such as a gelatinizer or a crosslinking agent); or an emulsion of a hydrophobic polymer, specific examples of which include styrene/butadiene rubber latex and acrylic resin emulsion. The binder is preferably incorporated into the heat-sensitive recording layer in an amount of 10 to 30% by dry mass.

If necessary, the following can also be added to the heat-sensitive recording layer: an antifoaming agent, a fluorescent dye, a coloring dye, an inorganic pigment, a wax, a higher fatty acid amide, a metal soap, an ultraviolet absorber, an antioxidant, a latex type binder, and so on. It is also effective to incorporate various additives used in known heat-sensitive recording material or pressure sensitive recording material into the heat-sensitive recording layer or other layers. Examples of the various additives include compounds described in, for example, JP-A Nos. 60-125470, 60-125471, 60-125472, 60-287485, 60-287486, 60-287487, 62-146680, 60-287488, 62-282885, 63-89877, 63-88380, 63-088381, 01-239282, 04-291685, 04-291684, 05-188687, 05-188686, 05-110490, 05-1108437, 05-170361, 63-203372, 63-224989, 63-267594, 63-182484, 60-107384, 60-107383, 61-160287, 61-185483, 61-211079, 63-2521282, and 63-051174, and JP-B Nos. 48-043294 and 48-033212.

(Microcapsules)

In order for the heat-sensitive recording layer to develop a color by receiving heat, it is preferable to make the color developing reaction of the above-mentioned color forming components heat-responsive. The color developing reaction can be made heat-responsive, for example, by encapsulating one component of the color forming component combination into heat-responding microcapsules. The method for this may be a method known in the related art. Examples thereof include methods using coacervataion of a hydrophilic wall forming material described in U.S. Pat. Nos. 2,800,457 and 28,000,458; interfacial polymerization methods described in U.S. Pat. No. 3,287,154, GB Patent No. 990443, and JP-B Nos. 38-19574, 42-446, and 42-771; methods based on polymer precipitation described in U.S. Pat. Nos. 3,418,250 and 3,660,304; a method using an isocyanate polyol wall material described in U.S. Pat. No. 3,796,669; a method using an isocyanate wall material described in U.S. Pat. No. 3,914,511; methods using a wall forming material of a urea-formaldehyde type or a urea-formaldehyde-resorcinol type described in U.S. Pat. Nos. 4,001,140, 4,087,376 and 4,089,802; a method using a wall forming material such as melamine-formaldehyde resin or hydroxypropylcellulose described in U.S. Pat. No. 4,025,455; in situ methods using the polymerization of a monomer described in JP-B No. 36-9168 and JP-A No. 51-9079; electrolytic dispersion cooling methods described in GB Patent Nos. 952807 and 965074; and spray drying methods described in U.S. Pat. No. 3,111,407 and GB Patent 930422.

As a method for microencapsulating the color forming component, it is preferable to adopt an interfacial polymerization method of dissolving or dispersing one of the components of the color forming component combination (for example, the electron-donating dye precursor in the combination (a), and the diazo compound in the combination (b)) into a hydrophobic organic solvent, which will become capsule cores, to prepare an oil phase, mixing the oil phase with a water phase in which a water-soluble polymer is dissolved, emulsifying the mixture with a homogenizer or some other means, and heating the emulsion to cause a polymer-forming reaction in the oil droplet interface to thereby form microcapsule walls made of a polymer. According to this method, capsules having an even particle size can be formed for a short time. Thus, a recording material excellent in unprocessed stock storability can be produced.

Reactants for forming the polymer are added to the inside of the oil droplets and/or the outside of the oil droplets. Specific examples of the polymer include polyurethane, polyurea, polyamide, polyester, polycarbonate, urea/formaldehyde resin, melamine resin, polystyrene, styrene/methacrylate copolymer, and styrene/acrylate copolymer. Among these examples, polyurethane, polyurea, polyamide, polyester and polycarbonate are preferable. Polyurethane and polyurea are particularly preferable. The polymers may also be used in combination of two or more thereof.

Examples of the water-soluble polymer include gelatin, polyvinyl pyrrolidone and polyvinyl alcohol. For example, in the case that polyurethane is used as capsule wall material, microcapsule walls can be formed by mixing a polyisocyanate and a second material which can react with it to form capsule walls (for example, polyol or polyamide) with a water-soluble polymer aqueous solution (water phase) or an oily medium to be encapsulated (oil phase), emulsifying the mixture, and heating the emulsion to cause a polymer forming reaction in the oil droplet interface. The particle size of the microcapsules is preferably from 0.1 to 1.0 μm, more preferably from 0.2 to 0.7 μm.

Other examples of the method for giving heat responsibility to the color developing reaction include a method of mixing a thermally meltable material having a low melting point with one component of the above-mentioned color forming component combination (for example, the electron-accepting compound in the combination (a), and the coupler compound in the combination (b), each of which may be referred to as the color developer as the case may be), and then adding the mixture as a eutectic material to the heat-sensitive recording layer; and a method of adding the low melting point compound and particles of the color developer to the heat-sensitive recording layer in the state that the compound is melted and adhered to the surface of the particles. The material used as the low melting point compound may be a wax. Examples of the wax include paraffin wax, carnauba wax, microcrystalline wax, polyethylene wax, higher fatty acid amides such as stearic amide and ethylenebisstearoamide, and higher fatty acid esters.

(Process for Producing the Heat-Sensitive Recording Material)

The heat-sensitive recording layer can be formed by applying a coating solution wherein the color forming component, and other components such as a binder, which is added if desired, are dissolved and/or dispersed, onto the resin coating layer and then drying the applied solution. As the method for applying the coating solution, a known coating method can be used, the examples thereof including blade coating, air knife coating, gravure coating, roll coating, spray coating, dip coating, bar coating, and extrusion coating methods.

The applied amount of the coating solution for forming the heat-sensitive recording layer is not limited, but is usually from 3 to 15 g/m$^2$, more preferably from 4 to 10 g/m$^2$ as dry mass.

If desired, in the heat-sensitive recording material of the invention, an intermediate layer can be formed between its two heat-sensitive recording layers, and a protective layer and an ultraviolet ray (light transmissivity) adjusting layer can be formed on its heat-sensitive recording layer. Examples of materials contained in each of the layers and the arrangement thereof may be those described in JP-A No. 11-34495, columns 39 to 60.

EXAMPLES

The heat-sensitive recording material of the present invention is specifically described by way of the following examples. However, the invention is not limited thereto. In the examples, the words "part(s)" and the symbol "%" represent "part(s) by mass" and "% by mass", respectively, unless otherwise specified.

Example 1

(Preparation of a Base Paper)

Wood pulp composed of 100% hardwood bleached pulp having a pulp concentration of about 3% was beaten to give pulp slurry having a Canadian freeness (in accordance with CFS standards) of 270 cc. While this slurry was stirred, (1) 1.0% anionic polyacrylamide, (2) 1.1% aluminum sulfate, and (3) 0.1% polyamidepolyamine epichlorohydrin, the percentage of which is expressed on the basis of the bone-dry mass of the pulp, were added thereto as shown in Table 1, and the pH of the pulp slurry was adjusted to 7.0±0.2 with (4) 4% aqueous sodium hydroxide, and (5) 0.25% epoxydized behenamide, (6) 0.35% cationic polyacrylamide, (7) 0.25% reaction product (a) of polyamine (DETA) and fatty acid (behenic acid), and if necessary (8) 0% (not added in this example) alkyl ketene dimer (number of carbon atoms: 22) (b), and (9) 0.1% higher alcohol antifoaming agent were added thereto.

A mixture (surface sizing solution) including (1) 4.82% polyvinyl alcohol (Poval KL-118 manufactured by Kuraray), (2) 4.63% calcium chloride, (3) 2.9% reaction product (c) of polyamine (DETA) and fatty acid (behenic acid), (4) 0% (not used in this example) surfactant (d), and (5) 0.009% higher alcohol antifoaming agent, the percentage of which is expressed on the basis of the bone-dry mass of the pulp, was prepared, then applied by a size pressing machine at a temperature of 35° C. and dried in an amount of about 30 g/m$^2$ on both surfaces of a paper substrate having a basis weight of 115 g/m$^2$ produced from the pulp slurry obtained above, and after the density (1.0 to 1.2 g/m$^3$) and thickness were regulated by a machine calender, the base paper used in the invention was obtained.

The resulting base paper was measured for its basis weight (g/m$^2$), density (g/m$^3$) in accordance with JIS P-8118, internal bond strength (kgf·cm) stipulated in JAPAN TAPPI paper pulp test method No. 18-2, and optical contact ratio Rp (μm) with a surface tester Microtopograph manufactured by Toyo Seiki Seisakusho., Ltd. in the sate that the base paper was pressed at a pressure of 5 kg/cm$^2$, and the results are shown in Table 2.

(Formation of a Polyethylene Coating Layer)

The wire (rear) face of the base paper was subjected to corona discharge treatment and then coated with a mixed resin of (high-density polyethylene/low-density polyethylene) to a resin thickness of 35 μm by a melt extrusion machine, to form a rear face resin layer having a mat surface. The felt (front) face of this base paper was subjected to corona discharge treatment and then coated with low-density polyethylene containing 10 parts of anatase type titanium oxide and a very small amount of ultramarine to a resin thickness of 50 μm by a melt extrusion machine, to form a front face resin layer having a glossy surface.

(Formation of an Undercoat Layer)

(1) Acetacetyl Modified PVA Solution 12.85 parts of acetacetyl modified PVA (Gohsefimer Z-210 having a saponification degree of 95 to 97% and a polymerization degree of about 1000, manufactured by The Nippon Synthetic Chemical Industry, Co., Ltd.) were added to and dissolved in 87.15 parts of water under stirring at 80° C. or more to give a solution containing the acetoacetyl modified polyvinyl alcohol at a concentration of 12.85%.

(2) 8% mica Dispersion

8% water-swelling synthetic mica dispersion (Somasif MEB-3 having an aspect ratio of 1000 and an average particle diameter of 2.0 μm, manufactured by Co-op Chemical).

(3) Insolubilizer

A glyoxal polyol reaction product SEQUARETZ 755 (55% solution manufactured by OMNOVA Solutions Inc., US)

(4) 1.66% ethylene oxide surfactant Solution in methanol 2.41 parts of water and 84.89 parts of methanol were added to 100 parts of the acetoacetyl modified PVA solution in (1) above, sufficiently stirred and mixed, and then 18.90 parts of the mica dispersion in (2) above were added thereto, stirred and mixed, and 3.1 parts of the surfactant in (4) above were added thereto. Thereafter, while the temperature of the solution was kept at 35 to 40° C., 0.234 part of the insolubilizer in (3) above was added thereto to prepare an undercoat layer coating solution (concentration 6.93%).

The front face of the support comprising the base paper formed above, each surface of which was coated with polyethylene, was subjected to corona discharge treatment, and then the undercoat layer coating solution obtained above was applied in an amount of 0.87 g/m$^2$ in terms of solids content onto the front face with a gravure roll with 100-mesh slanted line, to give the desired paper support provided with an undercoat layer.

A surface shape measuring device "Nanometro 110F"manufactured by Kuroda Precision Industries Ltd. was used to measure the three dimensional surface roughness (SRa) of the front face of the paper support coated with the undercoat layer under the following conditions. The results are shown in Table 2.

<Measurement and Analysis Conditions>

Scanning direction: MD direction in the sample

Measurement length: 50 mm in the X direction, and 30 mm in the Y direction

Measurement pitch: 0.1 mm in the X direction, and 0.1 mm in the Y direction

Scanning speed: 30 mm/second

Band pass filter: 1 to 2 mm (Preparation of a Heat-Sensitive Recording Layer Coating Solution (A))

(1) Capsule Solution in which an Electron-Donating Dye Precursor was Encapsulated Into 20 parts of ethyl acetate were dissolved 3.0 parts of crystal violet lactone as an electron-donating dye precursor, and further thereto were added 20 parts of alkylnaphthalene as a high boiling point solvent. These components were heated and mixed into a homogeneous state. To this solution were added 20 parts of a xylylene diisocyanate/trimethylolpropane adduct as a capsule wall agent, and then the mixture was stirred into a homogeneous state, so as to yield an electron-donating dye precursor solution.

Separately, 54 parts of a 6% gelatin aqueous solution were prepared. Thereto was added the electron-donating dye precursor solution, and the resultant was emulsified with a homogenizer. To the resultant emulsion were added 68 parts of water, and the mixture was made homogeneous. Thereafter, the temperature of the homogeneous mixture was raised to 50° C. while stirred. Encapsulating reaction was then continued for 3 hours to yield a target electron-donating dye precursor encapsulated capsule solution. The average particle size of the capsules was 1.6 μm.

(2) Preparation of an Electron-Accepting Compound Dispersion

To 150 parts of a 4% gelation aqueous solution were added 30 parts of bisphenol A as an electron-accepting compound, and the compound was dispersed in the solution with a ball mill for 24 hours to prepare an electron-accepting compound dispersion. The average particle size of the electron-accepting compound particles in the dispersion was 1.2 μm.

(3) Preparation of a Heat-Sensitive Recording Layer Coating Solution (A)

Next, the electron-donating dye precursor encapsulated capsule solution was mixed with the electron-accepting compound dispersion to set the ratio of the electron-donating dye precursor to the electron-accepting compound to ½, thereby yielding a target heat-sensitive recording layer coating solution (A).

(Preparation of a Heat-Sensitive Recording Layer Coating Solution (B))

(1) Preparation of a Capsule Solution in which a Diazonium Salt was Encapsulated Into 20 parts of ethyl acetate were dissolved 2.0 parts of 4-(N-(2,4-di-tert-amylphenoxy)butyryl)piperazinobenzenediazonium hexafluorophosphate as a diazonium slat, and further thereto were added 20 parts of alkylnaphthalene as a high boiling point solvent. These components were heated and mixed into a homogeneous state. To this solution were added 15 parts of a xylylene diisocyanate/trimethylolpropane adduct as a capsule wall agent, and then the mixture was stirred into a homogeneous state, so as to yield a diazonium salt compound solution.

Separately, 54 parts of a 6% gelatin aqueous solution were prepared. Thereto was added the diazonium salt compound solution, and the resultant was emulsified with a homogenizer. To the resultant emulsion were added 68 parts of water, and the mixture was made homogeneous. Thereafter, the temperature of the homogeneous mixture was raised to 40° C. while stirred. Encapsulating reaction was then continued for 3 hours to yield a target diazonium salt compound encapsulated capsule solution. The average particle size of the capsules was 1.1 μm.

(2) Preparation of a Coupler Emulsion

Into 10 parts of ethyl acetate were dissolved 2 parts of 1-(2'-octylphenyl)-3-methyl-5-pyrazolone as a coupler, 2 parts of 1,2,3-triphenylguanidine, 2 parts of 1,1-(p-hydroxyphenyl)-2-ethylhexane, 4 parts of 4,4'-(p-phenylenediisopropylidene)diphenol, 4 parts of 2-ethylhexyl-4-hydroxybenzoate, 0.3 part of tricresyl phosphate, 0.1 part of diethyl maleate, and 1 part of a 70% solution of calcium dodecylbenzenesolfonate in methanol. This solution was added to 80 parts of an 8% gelation aqueous solution, and the mixture was emulsified with a homogenizer for 10 minutes. Ethyl acetate was then removed therefrom to yield a target coupler emulsion.

(3) Preparation of a Heat-Sensitive Recording Layer Coating Solution (B)

Next, the diazonium salt encapsulated capsule solution was mixed with the coupler emulsion to set the ratio of the diazonium salt compound to the coupler to 2/3, thereby yielding a target heat-sensitive recording layer coating solution (B).

(Preparation of a Heat-Sensitive Recording Layer Coating Solution (C))

(1) Preparation of a Capsule Solution in which a Diazonium Salt was Encapsulated Into 20 parts of ethyl acetate were dissolved 3.0 parts of 2,5-dibutoxy-4-tolylthiobenzenediazonium hexafluorophosphate as a diazonium slat, and further thereto were added 20 parts of alkylnaphthalene as a high boiling point solvent. These components were heated and mixed into a homogeneous state. To this solution were added 15 parts of a xylylene diisocyanate/trimethylolpropane adduct as a capsule wall agent, and then the mixture was stirred into a homogeneous state, so as to yield a diazonium salt compound solution.

Separately, 54 parts of a 6% gelatin aqueous solution were prepared. Thereto was added the diazonium salt compound solution, and the mixture was emulsified with a homogenizer. To the resultant emulsion were added 68 parts of water, and the mixture was made homogeneous. Thereafter, the temperature of the homogeneous mixture was raised to 40° C. while stirred. Encapsulating reaction was then continued for 3 hours to yield a target diazonium salt compound encapsulated capsule solution. The average particle size of the capsules was 1.0 μm.

(2) Preparation of a Coupler Emulsion

Into 10 parts of ethyl acetate were dissolved 2 parts of 2-chloro-5-(3-(2,4-di-tert-pentyl)phenoxypropylamino)acetoacetoanilide as a coupler, 2 parts of 1,2,3-triphenylguanidine, 2 parts of 1,1-(p-hydroxyphenyl)-2-ethylhexane, 4 parts of 4,4'-(p-phenylenediisopropylidene)diphenol, 4 parts of 2-ethylhexyl-4-hydroxybenzoate, 0.3 part of tricresyl phosphate, 0.1 part of diethyl maleate, and 1 part of a 70% solution of calcium dodecylbenzenesolfonate in methanol. This solution was added to 80 parts of an 8% gelation aqueous solution, and the mixture was emulsified with a homogenizer for 10 minutes. Ethyl acetate was then removed therefrom to yield a target coupler emulsion.

(3) Preparation of a Heat-Sensitive Recording Layer Coating Solution (C)

Next, the diazonium salt encapsulated capsule solution was mixed with the coupler emulsion to set the ratio of the diazonium salt compound to the coupler to 4/5, thereby yielding a target heat-sensitive recording layer coating solution (C).

(Preparation of a Light Transmissivity Adjusting Layer Coating Solution)

(1) Preparation of a Capsule Solution Wherein an Ultraviolet Absorbent Precursor was Encapsulated Into 30 parts of ethyl acetate were dissolved 10 parts of [2-allyl-6-(2H-benzotriazole-2-yl)-4-t-octylphenyl]benzenesulfonate as an ultraviolet absorbent precursor, 3 parts of 2,5-di-t-octyl-hydroquinone, 2 parts of tricresyl phosphate and 4 parts of a-methylstyrene dimer. To this solution were added 20 parts of a xylylene diisocyanate/trimethylolpropane adduct as a capsule wall agent, and then the mixture was stirred into a homogeneous state, so as to yield an ultraviolet absorbent precursor solution.

Separately, 200 parts of an 8% solution of itaconic acid modified polyvinyl alcohol in water were prepared. Thereto was added the ultraviolet absorbent precursor solution, and the mixture was emulsified with a homogenizer. To the resultant emulsion were added 120 parts of water, and the mixture was made homogeneous. Thereafter, the temperature of the homogeneous mixture was raised to 40° C. while stirred. Encapsulating reaction was then continued for 3 hours to yield a target ultraviolet absorbent precursor encapsulated capsule solution. The average particle size of the capsules was 0.3 μm.

(2) Preparation of a Light Transmissivity Adjusting Layer Coating Solution

To 100 parts of the ultraviolet absorbent precursor encapsulated capsule solution were added 10 parts of a 2% solution of sodium [4-nonylphenoxytrioxyethylene]butysulfonate in water, so as to yield a target light transmissivity adjusting layer coating solution.

(Preparation of an Intermediate Layer Coating Solution)

To 100 parts of a 10% gelation aqueous solution were added 2 parts of a 2% solution of sodium (4-nonylphenoxytrioxyethylene)butylsulfonate in water, so as to yield a target intermediate layer coating solution.

(Preparation of a Protective Layer Coating Solution)

To 61 parts of a 5.0% solution of ethylene-modified polyvinyl alcohol in water were added 2.0 parts of a 20.5% zinc stearate dispersion ("Hydrin F115", manufactured by Chukyo Yushi Co., Ltd.), and then thereto were further added 8.4 parts of a 2% solution of sodium (4-nonylphenoxytrioxyethylene)butylsulfonate in water, 8.0 parts of a fluorine-containing releasing agent ("ME-313", manufactured by Daikin Industries, Ltd.) and 0.5 part of wheat starch. The mixture was stirred into a homogeneous state so as to prepare a PVA solution. Specifically, 12.5 parts of a 20% solution of a Kaogloss (manufactured by Shiraishi Kogyo Kaisha, Ltd.) in water, 1.25 part of 10% polyvinyl alcohol ("PVA 105", manufactured by Kurary Co., Ltd.) and 0.39 part of a 2% solution of sodium dodecylsulfonate in water were mixed to disperse the pigment with a Dyno mill, so as to prepare a pigment dispersion. To 80 parts of the above-mentioned PVA solution were added 4.4 parts of the pigment dispersion so as to yield a target protective layer coating solution.

(Formation of a Heat-Sensitive Recording Layer)

The following coating solutions were continuously applied onto the support coated with the undercoat layer by multicoating at an applying speed of 60 m/minute in the following order: the heat-sensitive recording layer coating solution (A), the intermediate layer coating solution, the heat-sensitive recording layer coating solution (B), the intermediate layer coating solution, the heat-sensitive recording layer coating solution (C), the light transmissivity adjusting layer coating solution, and the protective layer coating solution. The applied coating solutions were then dried at a temperature of 30° C. and a humidity of 30% RH, and at a temperature of 40° C. and a humidity of 30% RH, so as to produce a heat-sensitive recording material of the invention. The above-mentioned coating solutions were applied in such a manner that the applied amount of the solid content in each of the seven layers would be as follows: the heat-sensitive recording layer (A): 6.0 g/m$^2$; the intermediate layer: 3.0 g/m$^2$; the heat-sensitive recording layer (B): 6.0 g/m$^2$; the intermediate layer: 3.0 g/m$^2$; the heat-sensitive recording layer (C): 5.0 g/m$^2$; the light transmissivity adjusting layer: 3.0 g/m$^2$; and the protective layer: 1.5 g/m$^2$.

Example 2

The heat-sensitive recording material of the invention was prepared in the same manner as in Example 1 except that in the preparation of the base paper in Example 1, the amounts of (7) reaction product (a) of polyamine and fatty acid and (8) alkyl ketene dimer (b) added to the pulp slurry, the type of fatty acid in (3) reaction product (c) of polyamine and fatty acid, and the amount of the reaction product (c) added to the sizing solution were changed as shown in Table 1.

Example 3

The heat-sensitive recording material of the invention was prepared in the same manner as in Example 1 except that in the preparation of the base paper in Example 1, the amounts of (7) reaction product (a) of polyamine and fatty acid and (8) alkyl ketene dimer (b) added to the pulp slurry, the amount of (3) reaction product (c) of polyamine and fatty acid added to the sizing solution, and the type and amount of (4) surfactant (d) added were changed as shown in Table 1.

Example 4

The heat-sensitive recording material of the invention was prepared in the same manner as in Example 1 except that in the preparation of the base paper in Example 1, the amounts of (7) reaction product (a) of polyamine and fatty acid and (8) alkyl ketene dimer (b) added to the pulp slurry, the amount of (3) reaction product (c) of polyamine and fatty acid added to the sizing solution, and the type and amount of (4) surfactant (d) added were changed as shown in Table 1.

Example 5

The heat-sensitive recording material of the invention was prepared in the same manner as in Example 4 except that in the preparation of the base paper in Example 4, the type and amount of (4) surfactant (d) added to the sizing solution were changed as shown in Table 1.

Example 6

The heat-sensitive recording material of the invention was prepared in the same manner as in Example 4 except that in the preparation of the base paper in Example 4, the type and amount of (4) surfactant (d) added to the sizing solution were changed as shown in Table 1.

Comparative Example 1

The heat-sensitive recording material of the invention was prepared in the same manner as in Example 1 except that in the preparation of the base paper in Example 1, the amount of (8) alkyl ketene dimer (b) added to the pulp slurry was changed as shown in Table 1, and (3) reaction product (c) of polyamine and fatty acid and (4) surfactant (d) were not added to the sizing solution Comparative Example 2

A comparative heat-sensitive recording material was prepared in the same manner as in Example 1 except that in the preparation of the base paper in Example 1, the amounts of (7) reaction product (a) of polyamine and fatty acid and (8) alkyl ketene dimer (b) added to the pulp slurry, and the amount of (3) reaction product (c) of polyamine and fatty acid, and the type and amount of (4) surfactant (d) added to the sizing solution, were changed as shown in Table 1.

(Evaluation test)

The heat-sensitive recording materials obtained above were examined in the following evaluation test, and the results are shown in Table 2.

(1) Image Evaluation

Image processing software Adobe Photo Shop 7.0 was used to form a cyan image wherein tones (0 to 255 tones) of 3 colors were R=0, G=255 and B=255, and a plain colored cyan image was printed with Prinpix Digital Photo Printer CX-400 manufactured by Fuji Photo Film Co., Ltd., and the uniformity of the image was evaluated under the following criteria:

<Evaluation Criteria>

A: No uneven density.

B: Slight uneven density at allowable level.

C: Significant density unevenness (not allowable).

(2) Edge Exfoliation 10 samples cut in the A6 size were piled up and then allowed to slightly collide 10 times with a prepared glass plate so as to hit their angle on the glass plate, and the exfoliated state of the edge (presence or absence of interlaminar exfoliation of the base paper) was observed with naked eyes.

TABLE 1

| | Reaction product of polyamine and fatty acid (a) | Alkyl ketene dimer ($C_{22}$) (b) | Reaction product of polyamine and fatty acid (c) | Surfactant (d) |
|---|---|---|---|---|
| Example 1 | DETA + behenic acid, 0.25% | 0% | DETA + behenic acid, 2.9% | 0 |
| Example 2 | DETA + behenic acid, 0.10% | 0.25% | DETA + stearic acid, 4.4% | 0 |
| Example 3 | 0 | 0.25% | TETA + behenic acid, 3.5% | Plumer BS[4)], 0.28% |
| Example 4 | 0 | 0.25% | 0 | Toughron S-100[1)], 2.5% |
| Example 5 | 0 | 0.25% | 0 | Toughron Spin A[2)], 2.5% |
| Example 6 | 0 | 0.25% | 0 | Meika Softer A-208[3)], 2.8% |
| Comparative Example 1 | DETA + behenic acid, 0.25% | 0.25% | 0 | 0 |
| Comparative Example 2 | 0 | 0.50% | 0 | Plumer BS[4)], 3.0% |

Notes)
DETA (diethylene triamine), TETA (triethylene tetramine)
[1)]Polyamine-based compound manufactured by Dai-ichi Kogyo Seiyaku Co., Ltd.
[2)]Cationic surfactant manufactured by Dai-ichi Kogyo Seiyaku Co., Ltd.
[3)]Polyhydric alcohol-based surfactant manufactured by Meisei Kagaku Kogyo Co., Ltd.
[4)]Anionic surfactant manufactured by Dai-ichi Kogyo Seiyaku Co., Ltd.

TABLE 2

| | Basis weight ($g/m^2$) | Density ($g/m^3$) | Internal bond strength (kgf·cm) | Rp value (μm) | SRa value (μm) | Image evaluation | Occurrence of edge exfoliation |
|---|---|---|---|---|---|---|---|
| Example 1 | 115.2 | 1.15 | 1.31 | 4.2 | 0.143 | A | no |
| Example 2 | 114.6 | 1.09 | 1.30 | 3.7 | 0.116 | A | no |
| Example 3 | 116.1 | 1.13 | 1.35 | 5.6 | 0.175 | A | no |
| Example 4 | 113.8 | 1.07 | 1.45 | 6.5 | 0.228 | A | no |
| Example 5 | 115.0 | 1.04 | 1.47 | 6.3 | 0.213 | A | no |
| Example 6 | 116.7 | 1.18 | 1.43 | 6.1 | 0.196 | A | no |
| Comparative Example 1 | 113.1 | 1.16 | 1.68 | 8.6 | 0.305 | C | yes |
| Comparative Example 2 | 150.7 | 1.13 | 0.89 | 8.2 | 0.298 | C | yes |

As is evident from Tables 1 and 2, it was found that the heat-sensitive recording materials of the invention (Examples 1 to 6) are excellent materials having a base paper excellent in flatness, causing no edge exfoliation and showing high-quality uniform image without density unevenness. On the other hand, the heat-sensitive recording materials in Comparative Examples 1 and 2 were those inferior in flatness of the base paper, causing edge exfoliation and showing density unevenness in image and inferior in image qualities.

According to the invention, there can be provided a heat-sensitive recording material including a paper substrate which can be easily made flat by calendar treatment or the like and has a high paper strength, and giving an even and high-quality image with no density unevenness.

What is claimed is:

1. A heat-sensitive recording material comprising a support comprising a paper substrate, and a recording layer that is provided thereon and is capable of developing a color by application of heat; a support comprising a paper substrate, and a recording layer that is provided thereon and is capable of being melted and transferred by application of heat; or a support comprising a paper substrate, and a recording layer that is provided thereon and is capable of being sublimated and transferred by application of heat; wherein a base paper of the support is made from pulp slurry comprising at least (1) one kind of polyacrylamide or cationic starch and (2) at least one kind of alkyl ketene dimer and an epoxidized fatty acid amide as a sizing agent, and is produced by coating or impregnating at least one face thereof with (3) at least one kind of softening agent, wherein the softening agent comprises a reaction product of a polyamine and a fatty acid having 8 to 40 carbon atoms.

2. A heat-sensitive recording material according to claim 1, wherein the polyacrylamide has a molecular weight of 2,500,000 or more, the molecular weight being measured by gel permeation chromatography (GPC).

3. A heat-sensitive recording material according to claim 1, wherein an amount of the polyacrylamide added is 0.01 to 5.0% by mass relative to bone-dry pulp.

4. A heat-sensitive recording material according to claim 1, wherein the alkyl ketene dimer is represented by the following formula I:

Formula I

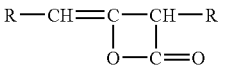

wherein R represents an alkyl group.

5. A heat-sensitive recording material according to claim 1, wherein the epoxidized fatty acid amide is represented by the following formula II:

Formula II

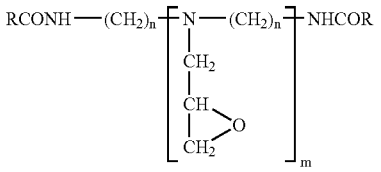

wherein R represents an alkyl group having 2 to 30 carbon atoms, m is an integer from 1 to 10, and n is an integer from 2 to 5.

6. A heat-sensitive recording material according to claim 1, wherein an amount of the epoxidized fatty acid amide added is 0.05 to 5.0% by mass relative to bone-dry pulp.

7. A heat-sensitive recording material according to claim 1, wherein the fatty acid having 8 to 40 carbon atoms is an aliphatic monocarboxylic acid or an aliphatic polycarboxylic acid.

8. A heat-sensitive recording material according to claim 1, wherein the polyamine is polyalkylenepolyamine.

9. A heat-sensitive recording material according to claim 1, wherein the softening agent comprises at least one of a polyhydric alcohol type nonionic surfactant and a cationic surfactant.

10. A heat-sensitive recording material according to claim 1, wherein the softening agent comprises a polyamine-based compound.

11. A heat-sensitive recording material according to claim 1, wherein an internal bond strength, of the base paper, in at least one direction selected from a lengthwise direction and a lateral direction thereof is 0.8 to 1.5 kgf·cm.

12. A heat-sensitive recording material according to claim 1, wherein the optical contact ratio (Rp) of the base paper is 7 μm or less, the optical contact ratio being measured while the base paper is pressed at a pressure of 5 $kg/cm^2$.

13. A heat-sensitive recording material according to claim 1, wherein at least a face on a recording side of the base paper is coated with a polyolefin resin.

14. A heat-sensitive recording material according to claim 13, wherein the face coated with the polyolefin resin has a three dimensional surface roughness SRa, with cutoff conditions of 1 mm or less and 2 mm or more, of 0.25 μm or less.

* * * * *